US009058023B2

(12) United States Patent
Harmon et al.

(10) Patent No.: US 9,058,023 B2
(45) Date of Patent: Jun. 16, 2015

(54) PORTABLE HEAD REST WITH STORAGE CONTAINER

(71) Applicants: Austin Harmon, Houston, TX (US); Floyd Harmon, Houston, TX (US)

(72) Inventors: Austin Harmon, Houston, TX (US); Floyd Harmon, Houston, TX (US)

( * ) Notice: Subject to any disclaimer, the term of this patent is extended or adjusted under 35 U.S.C. 154(b) by 200 days.

(21) Appl. No.: 13/931,998

(22) Filed: Jun. 30, 2013

(65) Prior Publication Data

US 2015/0003209 A1 Jan. 1, 2015

(51) Int. Cl.

| | |
|---|---|
| ***G04F 1/00*** | (2006.01) |
| ***A45C 11/20*** | (2006.01) |
| ***A47C 16/00*** | (2006.01) |
| ***A45C 13/00*** | (2006.01) |
| ***A45C 13/10*** | (2006.01) |
| ***A45C 15/00*** | (2006.01) |
| ***A45C 15/08*** | (2006.01) |

(52) U.S. Cl.

CPC ..... *G04F 1/005* (2013.01); *A45C 11/20* (2013.01); *A47C 16/00* (2013.01); *A45C 13/005* (2013.01); *A45C 13/1084* (2013.01); *A45C 15/00* (2013.01); *A45C 15/08* (2013.01)

(58) Field of Classification Search

CPC ..... A47G 9/10; A47G 9/1009; A47G 9/1045; A47G 9/1081; A61G 13/121; A61G 7/072; A47C 20/026; A47C 7/383; A47C 16/00; G04F 1/005; A45C 11/20; A45C 13/005; A45C 13/1084; A45C 15/00; A45C 15/08

See application file for complete search history.

(56) References Cited

U.S. PATENT DOCUMENTS

| | | | | |
|---|---|---|---|---|
| 3,298,477 | A * | 1/1967 | Martinez | 5/640 |
| 3,538,508 | A | 11/1970 | Young | |
| 4,235,472 | A * | 11/1980 | Sparks et al. | 5/638 |
| 5,819,346 | A * | 10/1998 | Lane | 5/639 |
| D405,308 | S | 2/1999 | Orozco | |
| 5,918,332 | A | 7/1999 | Dees | |
| 6,154,904 | A * | 12/2000 | Ehredt | 5/639 |
| 6,427,273 | B1 | 8/2002 | Berke et al. | |
| 6,493,891 | B1 | 12/2002 | Livingston | |
| 6,560,802 | B2 | 5/2003 | Fujii | |
| 6,601,804 | B2 | 8/2003 | Bisch | |
| D523,679 | S | 6/2006 | Illingworth | |
| 7,461,422 | B1 | 12/2008 | Baker | |
| 8,769,745 | B1 * | 7/2014 | Lin | 5/638 |
| 2005/0177946 | A1 * | 8/2005 | Riley | 5/638 |
| 2007/0277319 | A1 * | 12/2007 | Calvert | 5/638 |
| 2010/0155346 | A1 | 6/2010 | Cheng | |
| 2011/0175417 | A1 * | 7/2011 | Peled | 297/354.13 |
| 2012/0278993 | A1 | 11/2012 | Gard et al. | |

* cited by examiner

*Primary Examiner* — Peter M Cuomo
*Assistant Examiner* — Brittany Wilson
(74) *Attorney, Agent, or Firm* — Shannon L Warren

(57) ABSTRACT

A head rest system is disclosed. Said head rest system comprising a head rest assembly comprising a first side, a second side, a top side, a bottom side, a third side and a fourth side. Said top side and said bottom side are not parallel. Said top side comprises a tilted surface comprising a slope angle between said top side and said bottom side.

15 Claims, 15 Drawing Sheets

PORTABLE HEAD REST WITH STORAGE CONTAINER

BACKGROUND

This disclosure relates generally to a portable head rest with storage container. One example of a head rest can be found at U.S. Pat. No. 6,601,804. However, none of the known inventions and/or patents, taken either singularly or in combination, is seen to describe the instant disclosure as claimed. Accordingly, an improved head rest assembly would be advantageous.

SUMMARY

Two head rest systems are disclosed.

A first head rest system is disclosed. Said first head rest system comprising: a head rest assembly comprising a first side, a second side, a top side, a bottom side, a third side and a fourth side. Said top side and said bottom side are not parallel. Said top side comprises a tilted surface comprising a slope angle between said top side and said bottom side. Said head rest assembly comprises a compartment. Said head rest assembly comprising an upper portion and a lower portion. Said upper portion and said lower portion rotateably connected with a hinge. Said head rest assembly further comprising a one or more pads. Said one or more pads releaseably attached to said head rest assembly. Said one or more pads attach to said head rest assembly with a one or more hook-and-loop fasteners. Said head rest assembly comprising a lunch box. Said slope angle of said tilted surface being adjustable. Said head rest assembly comprising a handle. Said handle being releaseably attachable to said head rest assembly with a one or more handle fastening apertures. Said head rest assembly comprising a timer. Said timer being releaseably attachable to said head rest assembly. Said head rest assembly further comprising a slot capable of releaseably holding said timer. Said slot comprising a stopper, a first guide and a second guide.

A second head rest system is disclosed. Said second head rest system comprising a head rest assembly comprising a first side, a second side, a top side, a bottom side, a third side and a fourth side. Said top side and said bottom side are not parallel. Said top side comprises a tilted surface comprising a slope angle between said top side and said bottom side.

BRIEF DESCRIPTION OF THE DRAWINGS

FIG. 1A illustrates a front side perspective overview of said head rest assembly.

FIG. 1B illustrates a rear side lower perspective overview of said head rest assembly.

FIGS. 1C and 1D illustrate two elevated side views of said head rest assembly.

FIG. 1E illustrates an elevated top side view of said head rest assembly.

FIG. 9A illustrates a perspective overview and FIG. 9B illustrates an elevated front view of said head rest assembly in a sloped configuration, a tall configuration and a flat configuration.

DETAILED DESCRIPTION

Described herein is a portable head rest with storage container. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
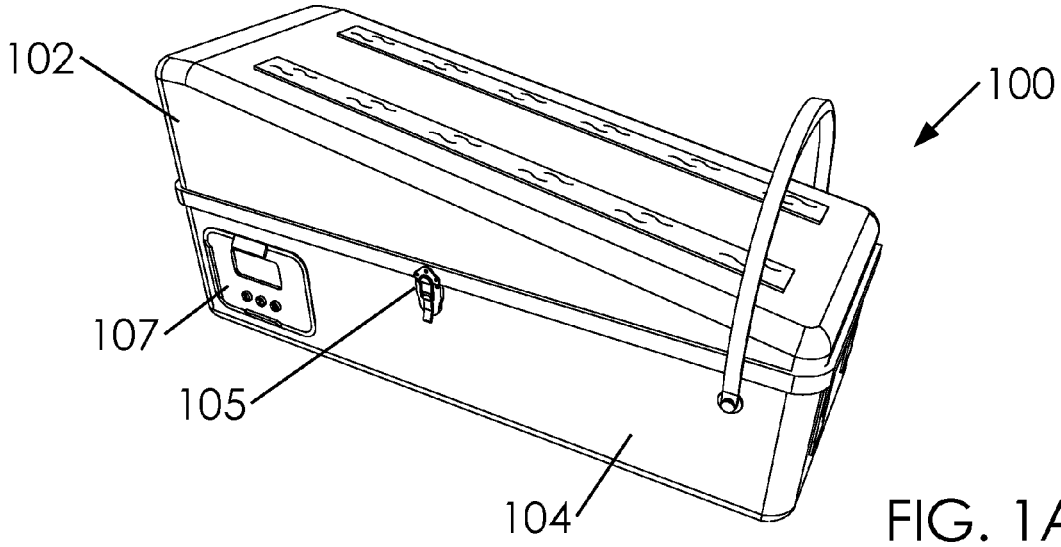
FIGS. 1A, 1B, 1C, 1D and 1E illustrate two perspective overviews and three elevated views of a head rest assembly.
Figure 1B:
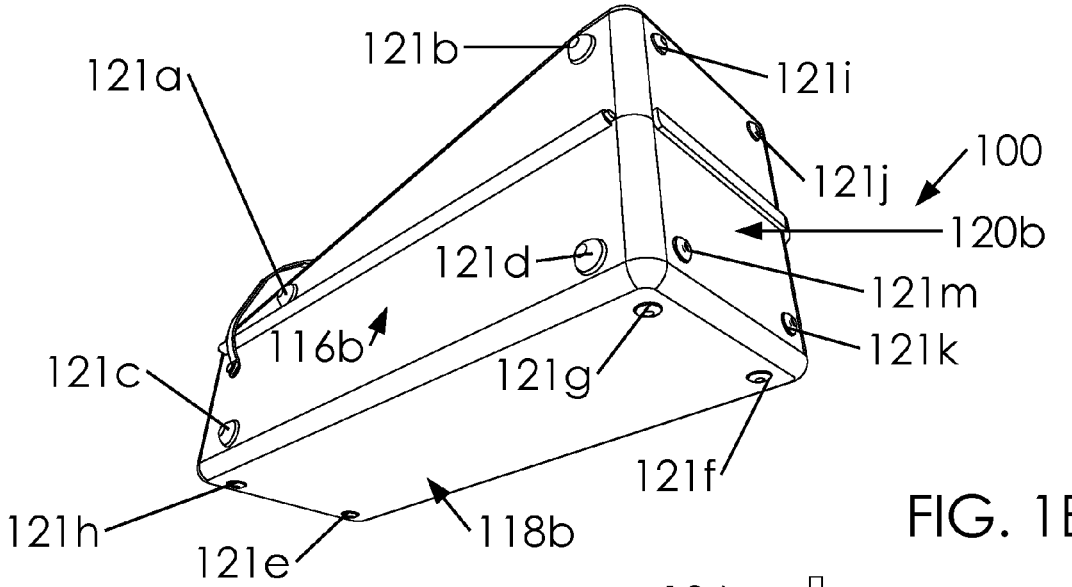
Figure 1C:
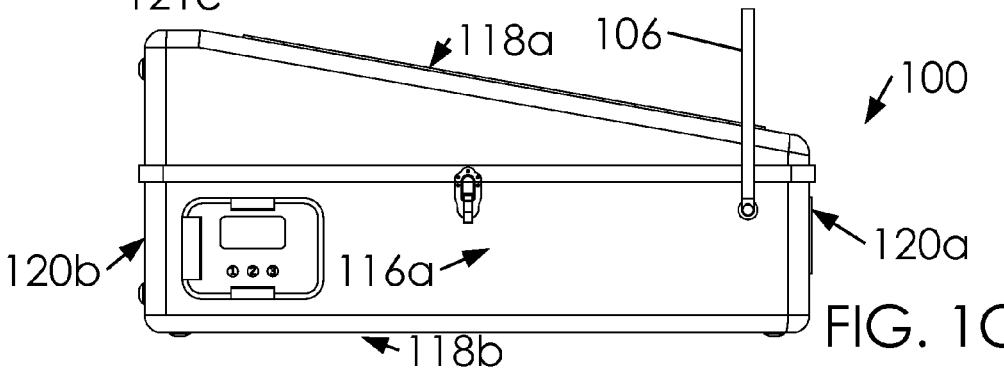
Figure 1D:
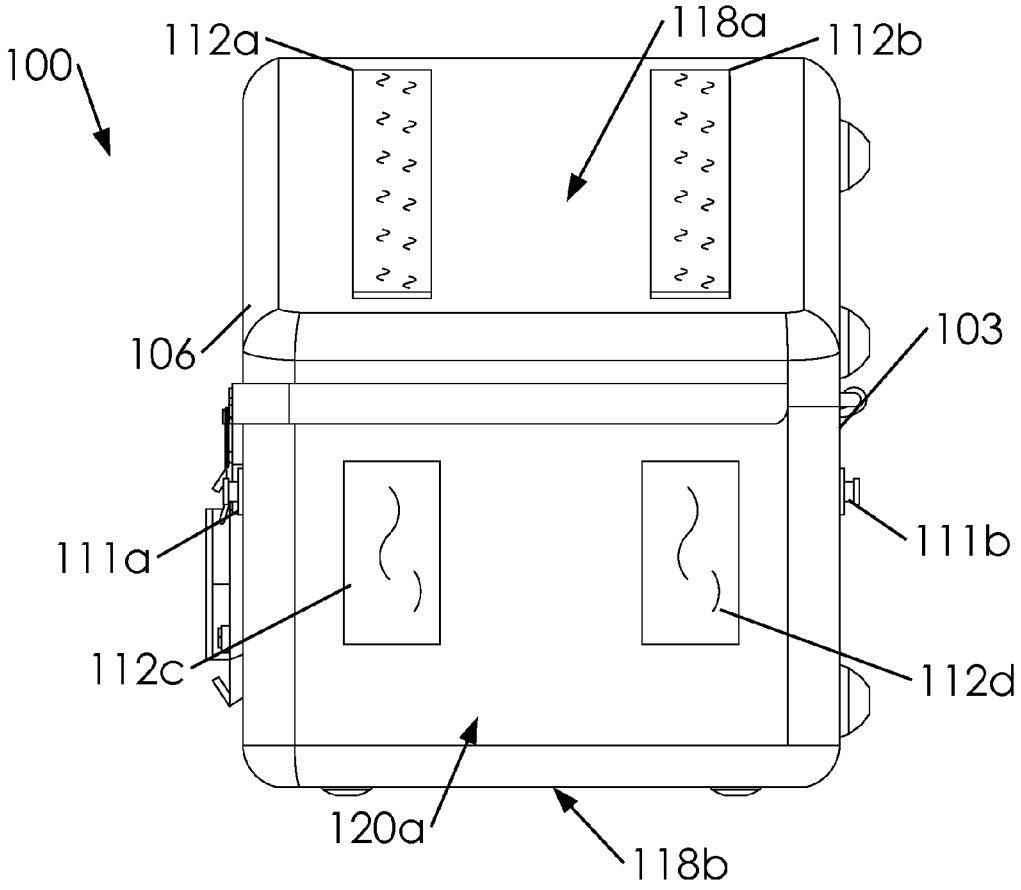
Figure 1E:
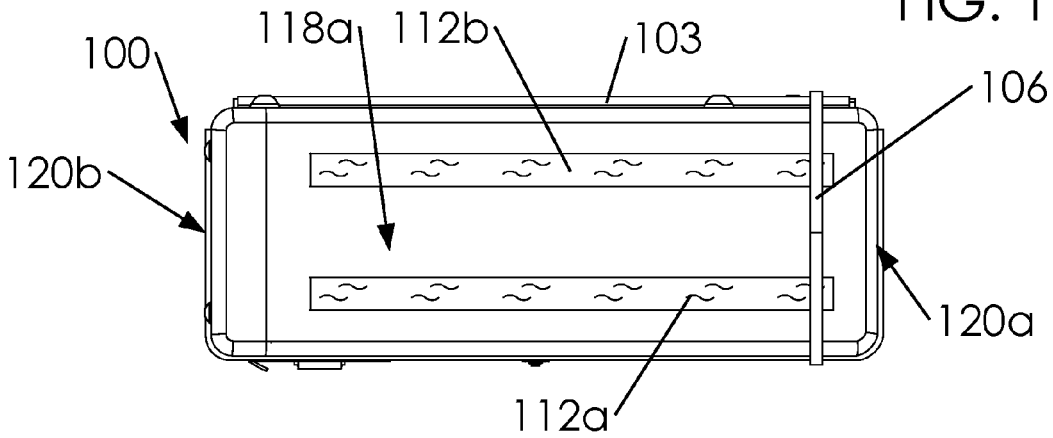

FIGS. 1A, 1B, 1C, 1D and 1E illustrate two perspective overviews and three elevated views of a head rest assembly 100. FIG. 1A illustrates a front side perspective overview of said head rest assembly 100. FIG. 1B illustrates a rear side lower perspective overview of said head rest assembly 100. FIGS. 1C and 1D illustrate two elevated side views of said head rest assembly 100. FIG. 1E illustrates an elevated top side view of said head rest assembly 100.

In one embodiment, said head rest assembly 100 can comprise an upper portion 102 and a lower portion 104 connected to one another at a hinge 103. In one embodiment, said upper portion 102 can be rotated relative to said lower portion 104 by rotating about said hinge 103. In one embodiment, said head rest assembly 100 can comprise a latch 105, a handle 106, a timer 107, a one or more handle fastening apertures, a one or more hook-and-loop fasteners and a one or more feet.

In one embodiment, said latch 105 can fasten a portion of said upper portion 102 to a portion of said lower portion 104. In one embodiment, said timer 107 can be used as a countdown timer. In one embodiment, said timer 107 can be programmed, as discussed infra.

In one embodiment, said one or more handle fastening apertures can comprise a first fastening aperture 111*a* and a second fastening aperture 111*b*. In one embodiment, said one or more fastening apertures can be used to attach said handle 106 to said head rest assembly 100. In one embodiment, said handle 106 can be detached from said one or more fastening apertures as desired. In one embodiment, said one or more fastening apertures can be manufactured into said head rest assembly 100 such that said one or more fastening apertures are approximately at the center of mass of said head rest assembly 100; accordingly, said handle 106 can support a balanced load within said head rest assembly 100. In one embodiment, said handle 106 can comprise a padding 115 which can be used to enhance comfort during portability of said head rest assembly 100.

In one embodiment, said one or more hook-and-loop fasteners comprising a first set of hook-and-loop fasteners and a second set of hook-and-loop fasteners. In one embodiment, said first set of hook-and-loop fasteners can comprise a first attachment 112*a*, a second attachment 112*b*, a third attachment 112*c* and a fourth attachment 112*d*. In one embodiment, said first set of hook-and-loop fasteners can releaseably attach to said upper portion 102 and/or said lower portion 104 to a one or more pads with said second set of hook-and-loop fasteners (illustrated and discussed, infra).

In one embodiment, said head rest assembly 100 can comprise said first side 116*a*, a second side 116*b*, said top side 118*a*, a bottom side 118*b*, a third side 120*a* and a fourth side 120*b*. In one embodiment, said third side 120*a* and said fourth side 120*b* can be of different lengths such that said top side 118*a* can comprise a tilted surface. In one embodiment, said first side 116*a*, said second side 116*b*, said bottom side 118*b*, said third side 120*a* and said fourth side 120*b* can be arranged as if said head rest assembly 100 were a rectangular box with each of the component parts are either perpendicular or parallel with each of the others; however, said top side 118*a* can comprise a tilted surface (that is not parallel with said bottom side 118*b*).

In one embodiment, said one or more feet can comprise: a first set of feet on said second side 116*b* comprising a first foot 121*a*, a second foot 121*b*, a third foot 121*c* and a fourth foot 121*d*; a second set of feet on said bottom side 118*b* comprising a fifth foot 121*e*, a sixth foot 121*f*, a seventh foot 121*g* and an eighth foot 121*h*; and a third set of feet on said fourth side 120*b* comprising a ninth foot 121*i*, a tenth foot 121*j*, an eleventh foot 121*k* and a twelfth foot 121*m*. In one embodiment, said one or more feet can allow said head rest assembly 100 to remain stationary on a surface without sliding and/or rocking on the one or more components of said head rest assembly 100, as will be apparent to one of ordinary skill in the art. In one embodiment, said one or more feet can comprise a rubber material to increase grip of said head rest assembly 100 on a surface (such as a desktop).

In one embodiment, said upper portion 102 and said lower portion 104 can have rounded corners for enhanced safety by ensuring no sharp corners are likely to harm users of said head rest assembly 100. In one embodiment, said upper portion 102 can be for proper ergonomic position for napping, as discussed, infra.

Figure 1F:
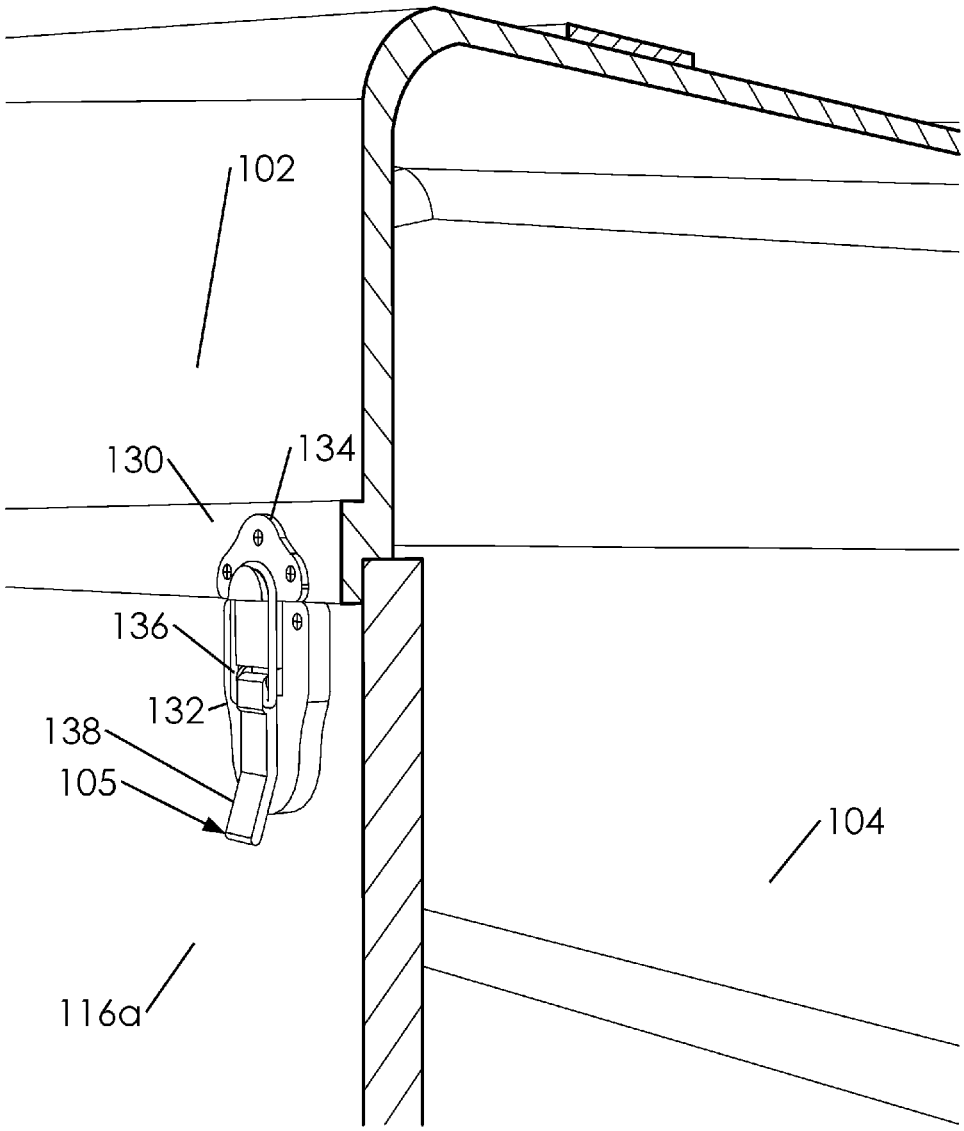
FIG. 1F illustrates a perspective cross-section view of a latch fastened to said upper portion of said head rest assembly.

FIG. 1F illustrates a perspective cross-section view of a latch 105 fastened to said upper portion 102 of said head rest assembly 100. In one embodiment, said upper portion 102 can comprise a lip 130 which overlaps with a portion of said lower portion 104. In one embodiment, said lip 130 can wrap around said head rest assembly 100 at said third side 120*a*, said fourth side 120*b* and said first side 116*a*. In one embodiment, said latch 105 can be mounted to said first side 116*a* of said lower portion 104, which can be on an opposite side of said head rest assembly 100 from said hinge 103. In one embodiment, said latch 105 can hold said upper portion 102 down with said lip 130 around a portion of said lower portion 104. In one embodiment, said latch 105 can comprise any of a variety of latch types, such as a draw latch as illustrated here. In one embodiment, said latch 105 can comprise a base portion 132, a draw plate 134, a lever 136, and a draw bar 138. In one embodiment, said base portion 132 can be attached on said lower portion 104 and said draw plate 134 can be attached on said upper portion 102. In one embodiment, said lever 136 can be pivotally connected to said base portion 132 for movement between closed and open positions. In one embodiment, said draw bar 138 can be pivotally connected to one end of said lever 136 with the other end can be releasably engaged with said draw plate 134. In one embodiment, said latch 105 can be placed into a locked position preventing said upper portion 102 from separating from said lower portion 104 by engaging said draw bar 138 into said draw plate 134 and depressing said lever 136 until parallel with said base portion 132. In one embodiment, said latch 105 can be placed into an unlocked position permitting said upper portion 102 to separate from said lower portion 104 by pivoting about said hinge 103. In one embodiment, unlocking said latch 105 can comprise lifting said lever 136 away from said base portion 132 and disengaging said draw bar 138 from said draw plate 134.

Figure 2A:
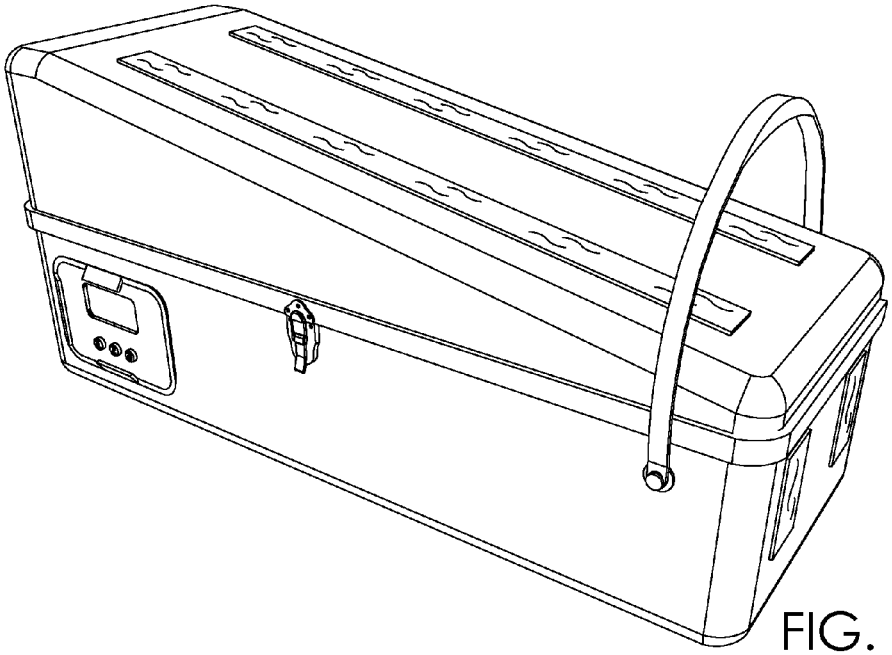
FIGS. 2A and 2B illustrate a perspective overview of said head rest assembly in a closed configuration and a perspective overview of said head rest assembly in an open configuration, respectively.
Figure 2B:
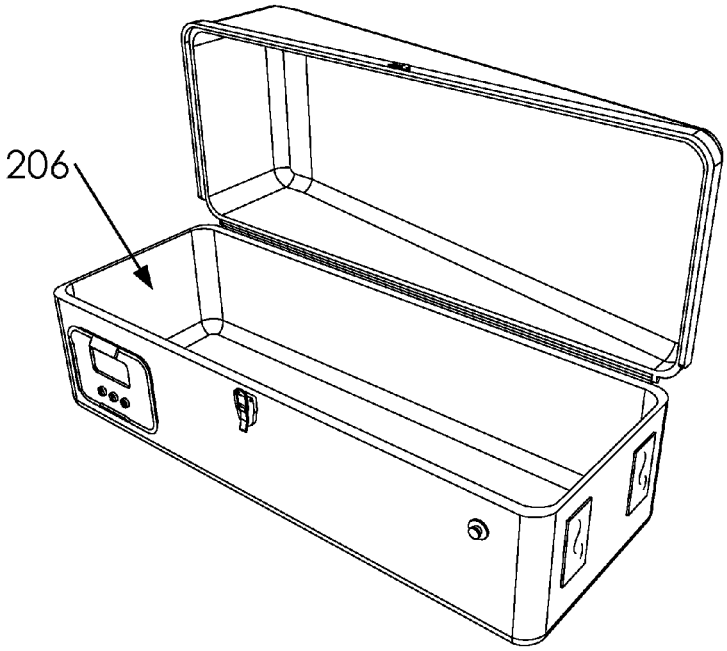

FIGS. 2A and 2B illustrate a perspective overview of said head rest assembly 100 in a closed configuration and a perspective overview of said head rest assembly 100 in an open configuration, respectively. In one embodiment, said head rest assembly 100 can be constructed of materials including but not limited to plastic, metal, rubber and wood. In one embodiment, said head rest assembly 100 can be made of transparent plastic and can also comprise various colors. In one embodiment, said head rest assembly 100 can easily be cleaned with a soft cloth and water. In one embodiment, said head rest assembly 100 can comprise a compartment 206. In one embodiment, said compartment 206 can be used to transport edible necessities or any other materials or goods as desired.

Figure 3A:
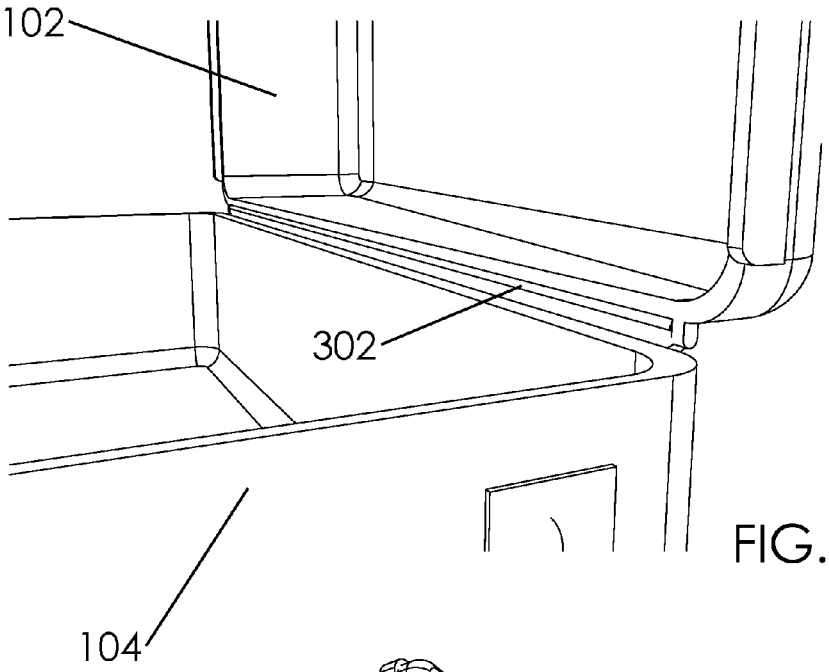
FIGS. 3A, 3B and 3C illustrate a perspective overview of an inner portion of said hinge, a perspective overview of an outer portion of said hinge and an elevated cross-section side view of said hinge.
Figure 3B:
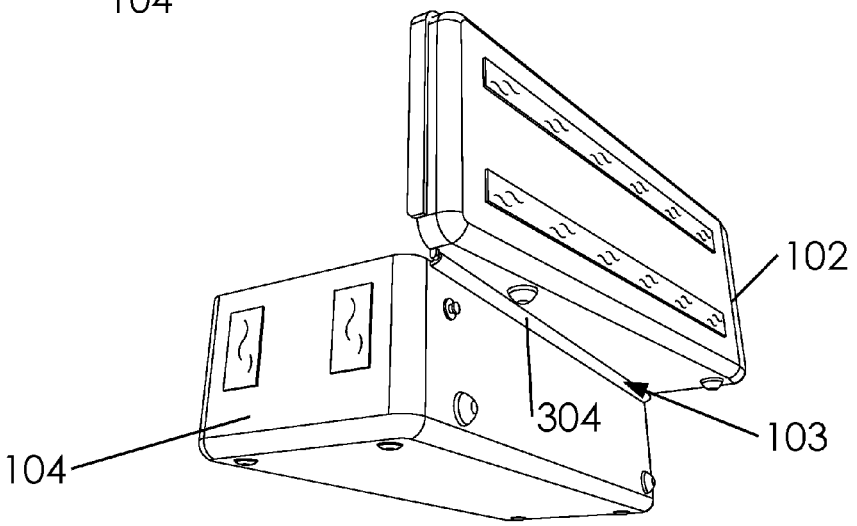
Figure 3C:
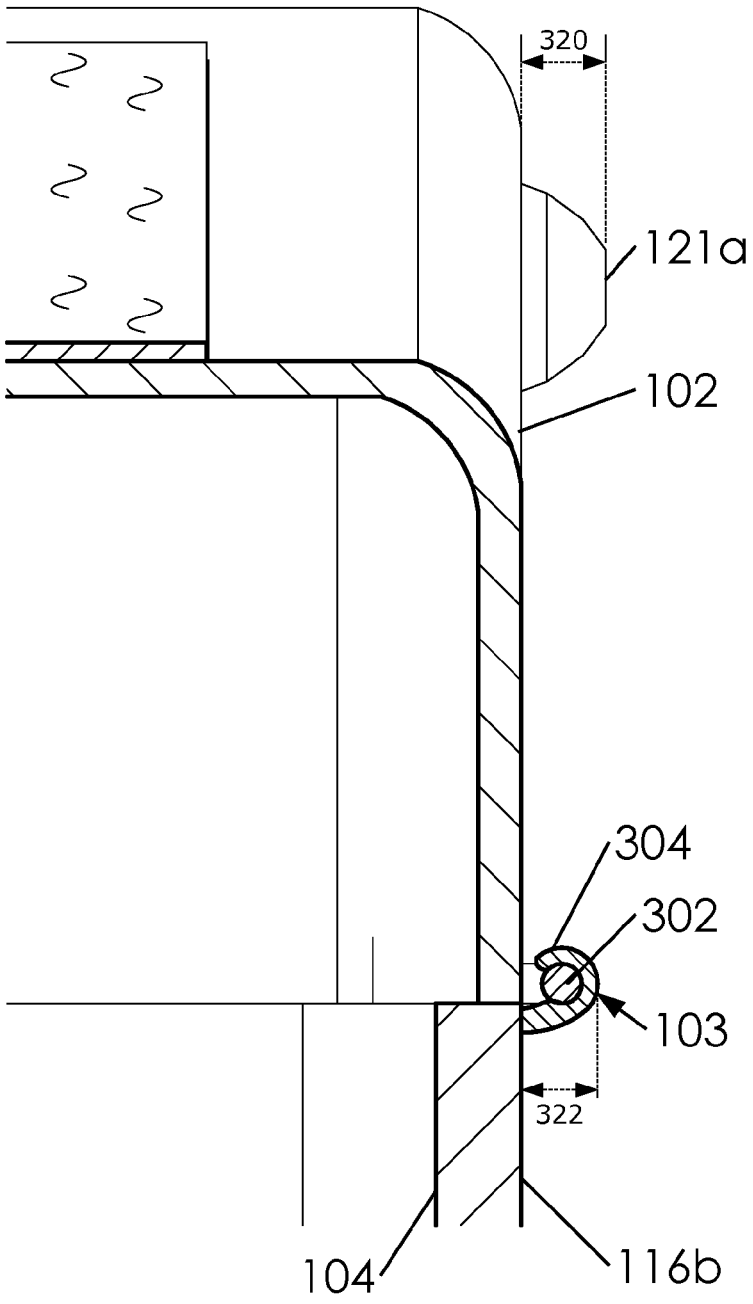
Figure 4A:
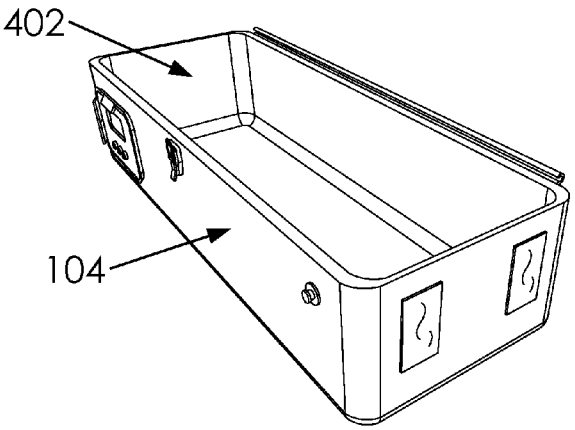
FIGS. 4A, 4B, 4C, 4D and 4E illustrate a perspective overview of said head rest assembly, an elevated view of said fourth side, an elevated view of said first side, an elevated view of said third side and an elevated top view of said lower portion.
Figure 4B:
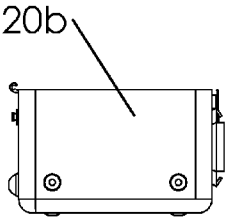
Figure 4C:
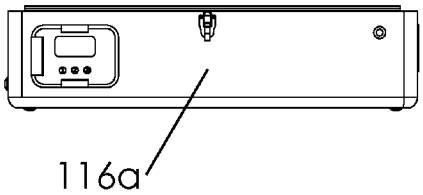
Figure 4D:
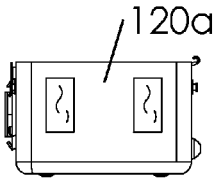
Figure 4E:
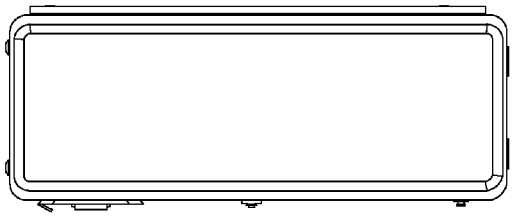
Figure 5A:
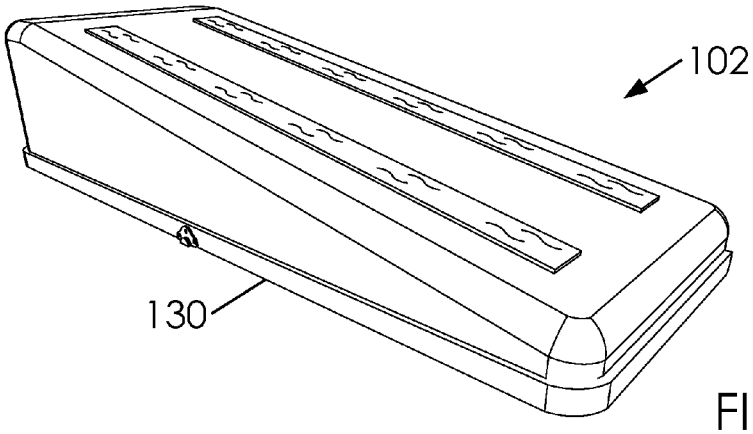
FIGS. 5A, 5B, 5C and 5D illustrate a perspective overview, an elevated view of said first side, an elevated view of said third side and an elevated view of said top side of said upper portion.
Figure 5B:
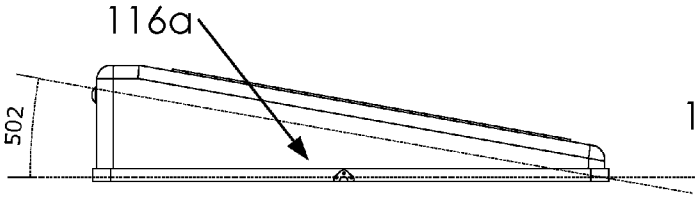
Figure 5C:
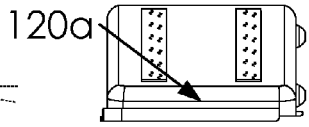
Figure 5D:
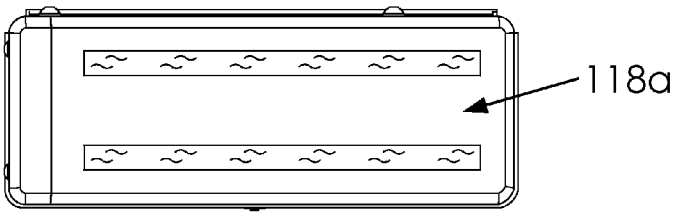

FIGS. 3A, 3B and 3C illustrate a perspective overview of an inner portion 302 of said hinge 103, a perspective overview of an outer portion 304 of said hinge 103 and an elevated cross-section side view of said hinge 103. In one embodiment, said hinge 103 can be used to rotateably connect said upper portion 102 of said head rest assembly 100 to said lower portion 104 of said head rest assembly 100. In one embodiment, said inner portion 302 of said hinge 103 can comprise a portion of said upper portion 102 and said outer portion 304 of said hinge 103 can comprise a portion of said lower portion 104. In one embodiment, a portion of said outer portion 304 of said hinge 103 can wrap around a portion of said inner portion 302 of said hinge 103. In one embodiment, said outer portion 304 of said hinge 103 can be held around said inner portion 302 of said hinge 103 by applying a tension about said inner portion 302 of said hinge 103, as is known in the art. In one embodiment, said upper portion 102 and said lower portion 104 of said head rest assembly 100 can be detached from one another at said hinge 103. In one embodiment, detaching said upper portion 102 from said lower portion 104 can be useful for cleaning said head rest assembly 100.

In one embodiment, said second side 116*b* can comprise a one or more components such as said first foot 121*a*, said hinge 103 and said second fastening aperture 111*b*; wherein, said one or more components on said second side 116*b* can each extend out from said second side 116*b* in different distances, and said first set of feet extend further than others among said one or more components on said second side 116*b*. For example, in one embodiment, said first foot 121*a* can comprise a depth 320, said hinge 103 can comprise a depth 322, and said second fastening aperture 111*b* can comprise a depth 324; wherein, said depth 320 is equal to or greater than said depth 322 and/or said depth 324 (as illustrated in FIG. 3C).

FIGS. 4A, 4B, 4C, 4D and 4E illustrate a perspective overview of said head rest assembly 100, an elevated view of said fourth side 120*b*, an elevated view of said first side 116*a*, an elevated view of said third side 120*a* and an elevated top view of said lower portion 104. In one embodiment, said lower portion 104 can comprise a lower compartment 402 comprising a portion of said compartment 206.

FIGS. 5A, 5B, 5C and 5D illustrate a perspective overview, an elevated view of said first side 116*a*, an elevated view of said third side 120*a* and an elevated view of said top side 118*a* of said upper portion 102. As discussed supra, said lip 130 can wrap around said upper portion 102 at said third side 120*a*, said first side 116*a* and said fourth side 120*b*. In one embodiment, said lip 130 can be at a lower edge of said upper portion 102. In one embodiment, said top side 118*a* can comprise a slope angle 502. In one embodiment, said slope angle 502 can be adjusted to fit the comfort profile of a user of said head rest assembly 100, as will be discussed, infra. In one embodiment, said slope angle 502 can be adjusted by either manufacturing said head rest assembly 100 to different fixed specifications or by installing an adjustable panel at or near said fourth side 120*b*.

Figure 6A:
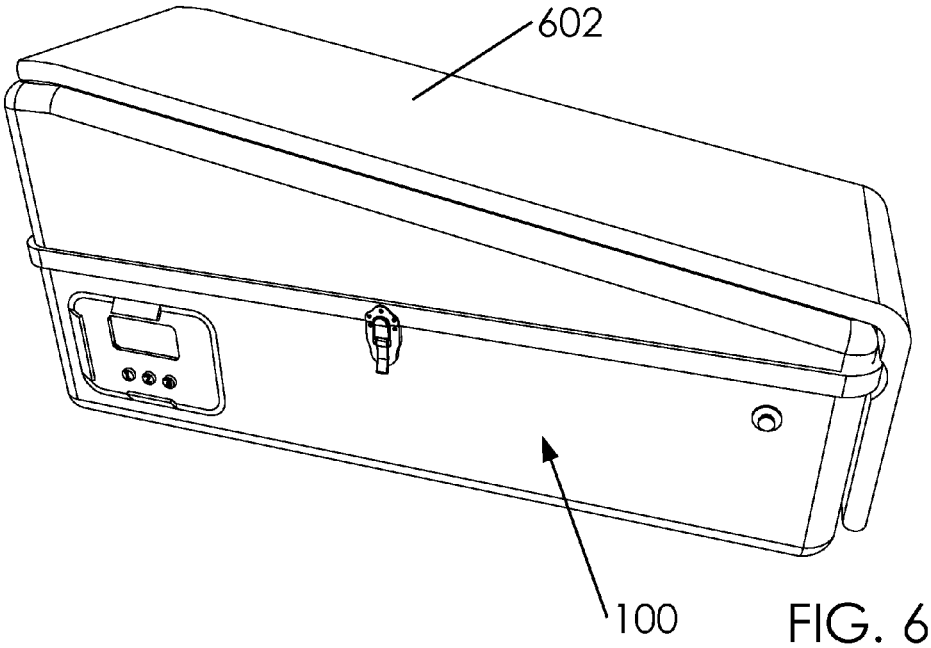
FIGS. 6A and 6B illustrate a side perspective overview of a wrap-around pad attached to said head rest assembly and an isolated side perspective overview of said wrap-around pad, respectively.
Figure 6B:
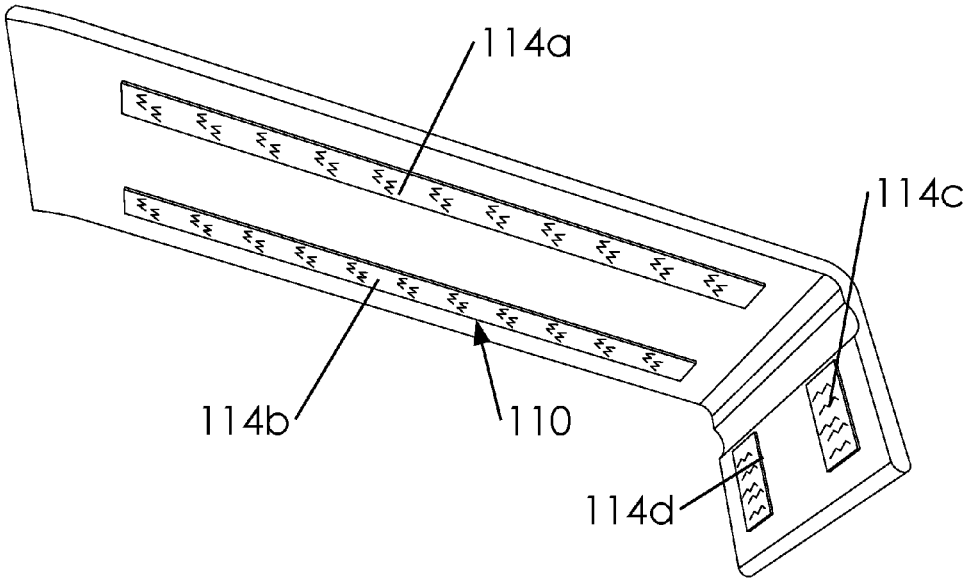

FIGS. 6A and 6B illustrate a side perspective overview of a wrap-around pad 602 attached to said head rest assembly 100 and an isolated side perspective overview of said wrap-around pad 602, respectively. In one embodiment, said wrap-around pad 602 can be made of leatherette material that can contain a soothing ergoprene gel support that can be antimicrobial protected. In one embodiment, said wrap-around pad 602 can have rounded corners and a soft finish for optimal comfort. In one embodiment, said wrap-around pad 602 can be removed for cleaning and sanitization of said head rest assembly 100 and said wrap-around pad 602, as desired. In one embodiment, said wrap around pad 602 can comprise a second attachment portion 110. In one embodiment, said second attachment portion 110 can comprise a first attachment 114*a*, a second attachment 114*b*, a third attachment 114*c* and a fourth attachment 114*d*. In one embodiment, said attachments can directly correspond to said first attachment 112*a*, said second attachment 112*b*, said third attachment 112*c* and said fourth attachment 112*d*. In one embodiment, said second attachment portion 110 can comprise a portion of a hook-and-loop fasteners capable of selectively attaching to said head rest assembly 100 as known in the art.

Figure 7A:
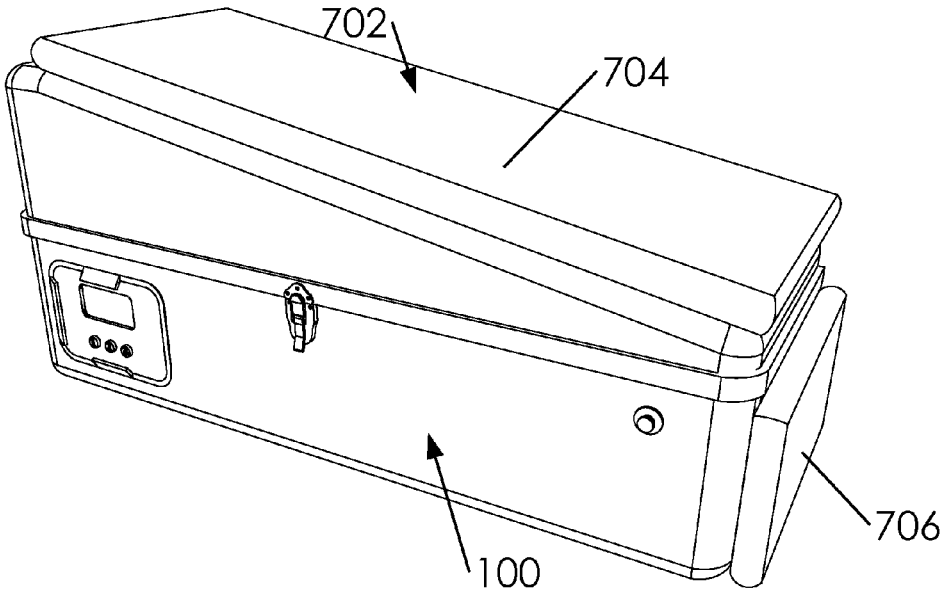
FIGS. 7A and 7B illustrate a side perspective overview of a set of pads attached to said head rest assembly and an isolated side perspective overview of said set of pads, respectively.
Figure 7B:
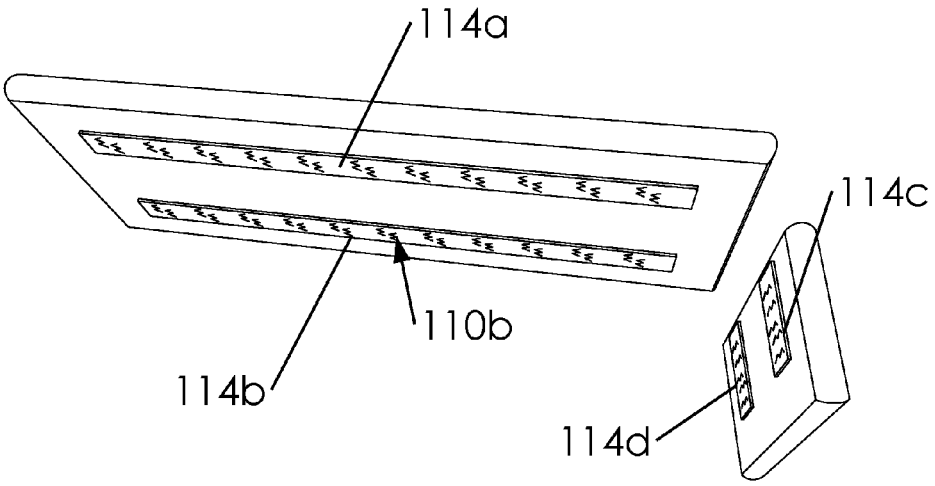

FIGS. 7A and 7B illustrate a side perspective overview of a set of pads 702 attached to said head rest assembly 100 and an isolated side perspective overview of said set of pads 702, respectively. In one embodiment, said set of pads 702 can be made of leatherette material that can contain a soothing ergoprene gel support that can be antimicrobial protected. In one embodiment, said set of pads can have rounded corners/edges and a soft finish for optimal comfort. In one embodiment, said set of pads 702 can be removed for cleaning and sanitization of said head rest assembly 100 and said set of pads 702, as desired. In one embodiment, said set of pads 702 can comprise a first pad 704 and a second pad 706. In one embodiment, said set of pads 702 can comprise said second attachment portion 110. In one embodiment, said second attachment portion 110 can comprise said first attachment 114*a*, said second attachment 114*b*, said third attachment 114*c* and said fourth attachment 114*d*. In one embodiment, said attachments can directly correspond to said first attachment 112*a*, said second attachment 112*b*, said third attachment 112*c* and said fourth attachment 112*d*; respectfully. In one embodiment, said second attachment portion 110 can comprise a portion of a hook-and-loop fasteners capable of selectively attaching to said head rest assembly 100 as known in the art.

Figure 8:
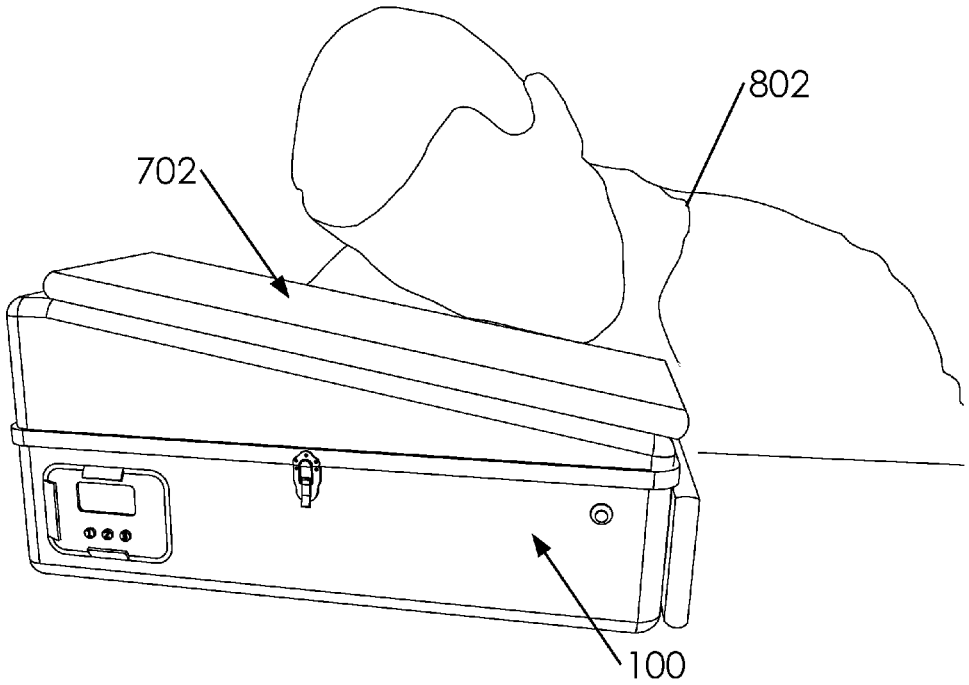
FIG. 8 illustrates a perspective overview of a user resting his head on said head rest assembly with said set of pads attached.

FIG. 8 illustrates a perspective overview of a user 802 resting his head on said head rest assembly 100 with said set of pads 702 attached. In one embodiment, said user 802 can position said head rest assembly 100 as necessary to find a comfortable resting position. In one embodiment, said upper portion 102 can be angled for left or right head resting, as desired by said user 802. For example, in one embodiment, said head rest assembly 100 can be rotated 180 degrees about said top side 118*a* so as to reverse said slope angle 502 relative to said user 802. In one embodiment, said slope angle 502 can be designed so as to maximize comfort to different users comprising different comfort requirements. In one embodiment, said head rest assembly 100 can be used without said pad 702 at all.

Figure 9A:
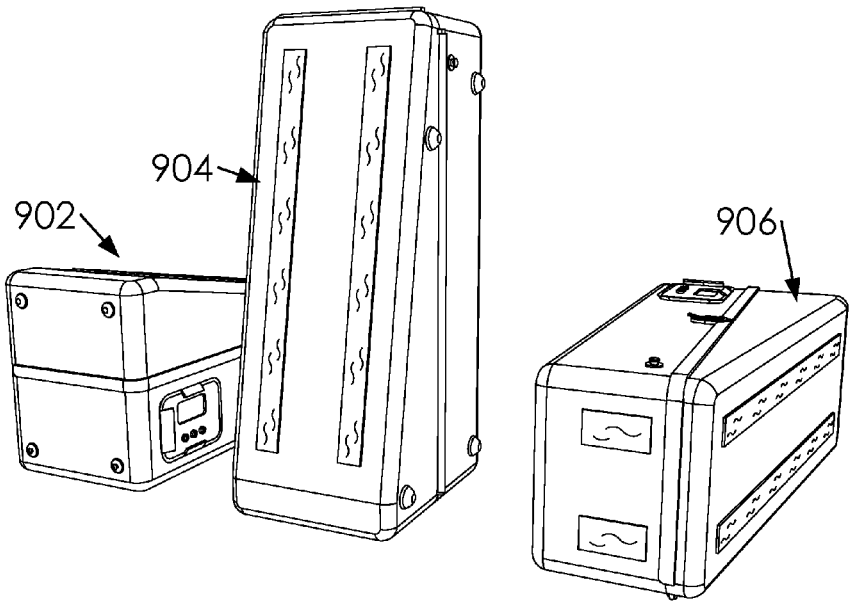
FIGS. 9A and 9B illustrate a series of perspective overviews of said head rest assembly.
Figure 9B:
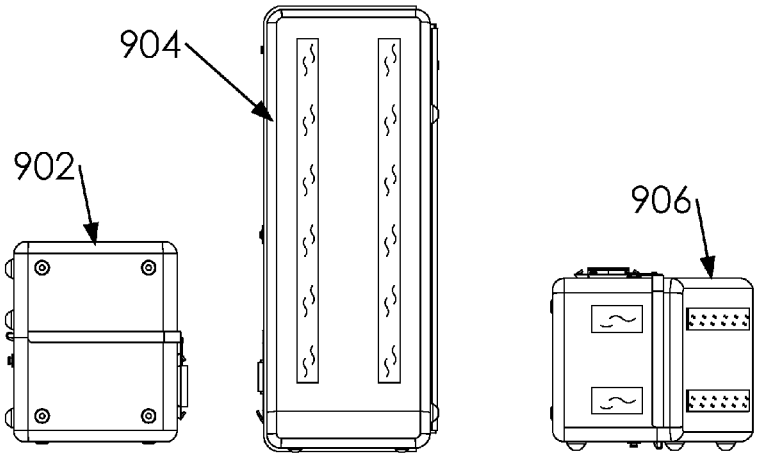

FIGS. 9A and 9B illustrate a series of perspective overviews of said head rest assembly 100. FIG. 9A illustrates a perspective overview and FIG. 9B illustrates an elevated front view of said head rest assembly 100 in a sloped configuration 902, a tall configuration 904 and a flat configuration 906. Thus, said head rest assembly 100 can be arranged to reconfigure an upward facing surface relative to the comfort needs of said user 802. For example, in one embodiment, said user 802 can use said slope angle 502 to rest his head at: a slope relative to a desk (see said sloped configuration 902); a flat but elevated position (see said tall configuration 904); or a flat surface relative to said desk (see flat configuration 906). In all such configurations, a portion of said pad 702 and/or said pad 602 can be used to cushion said user 802 where interfacing said head rest assembly 100.

Figure 10A:
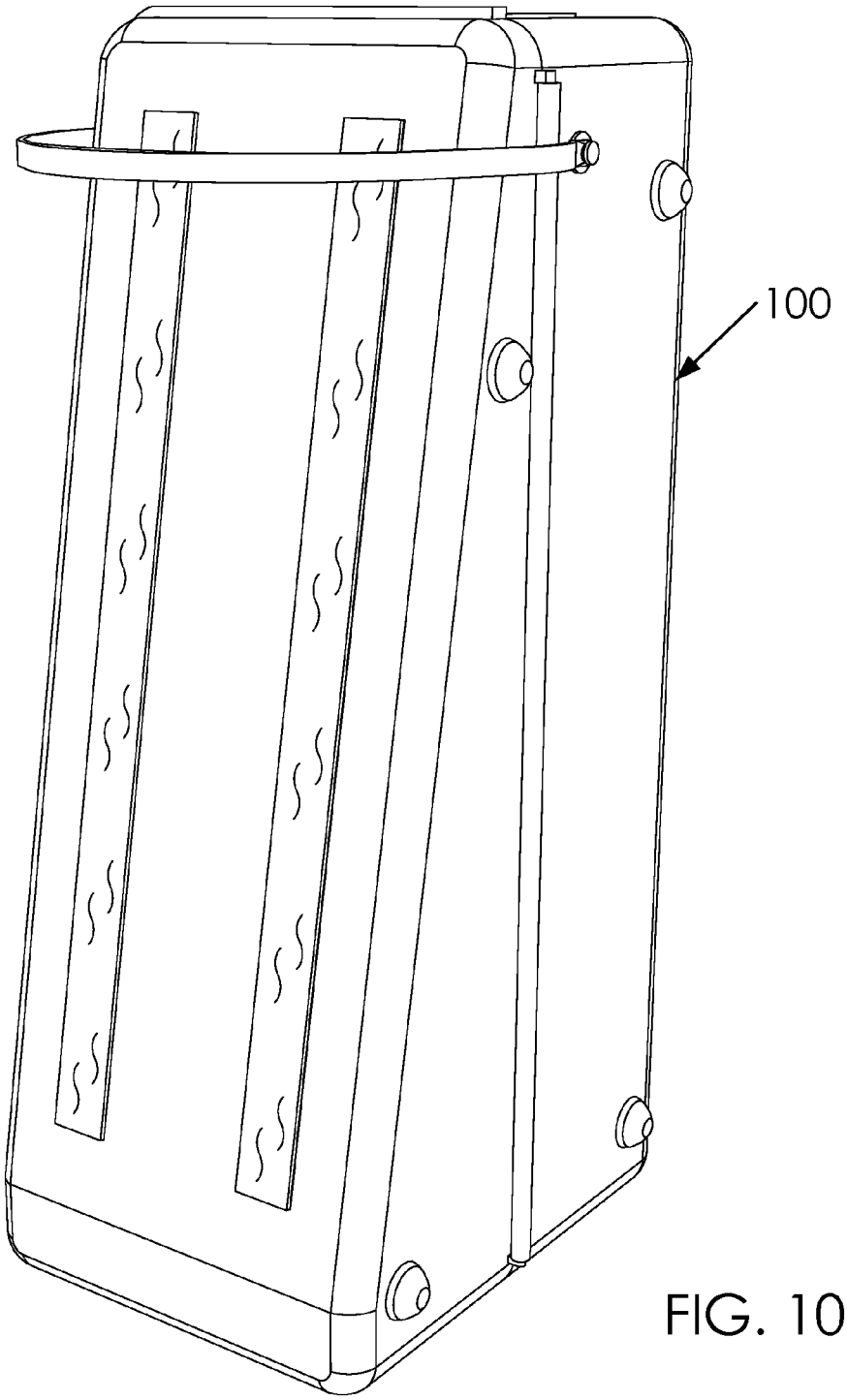
FIGS. 10A and 10B illustrate a perspective overview of said head rest assembly sitting on said fourth side.
Figure 10B:
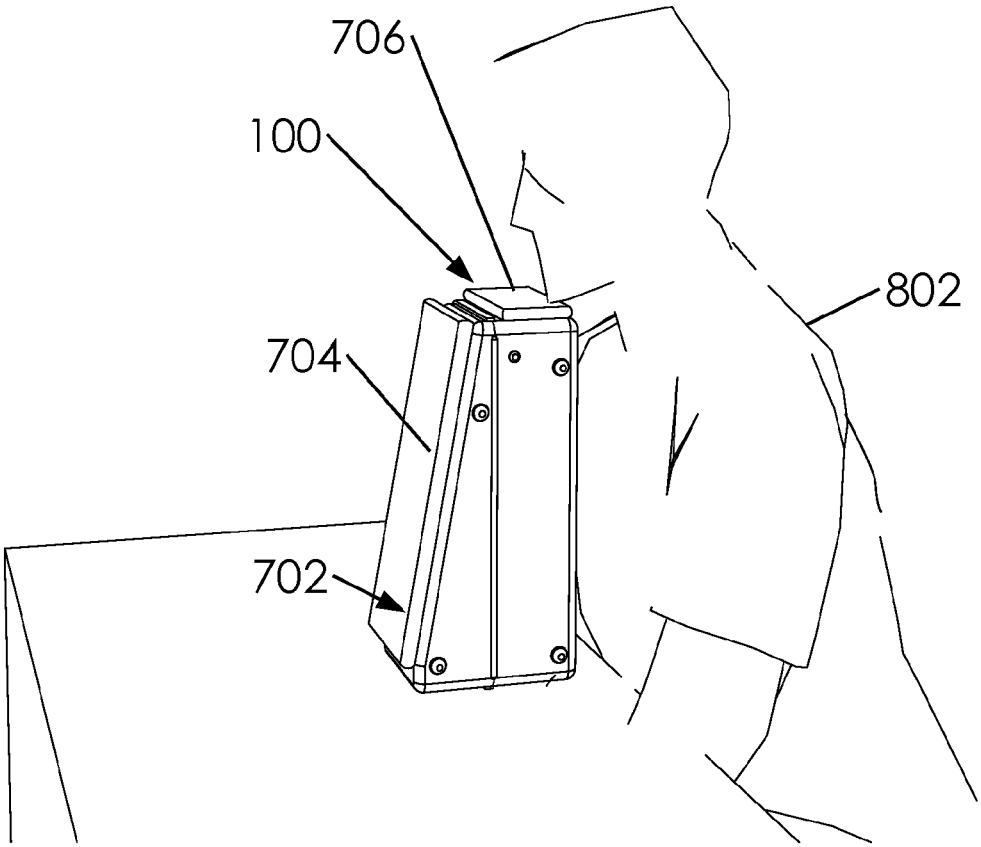

FIGS. 10A and 10B illustrate a perspective overview of said head rest assembly 100 sitting on said fourth side 120*b*. In one embodiment, said head rest assembly 100 can sit on said fourth side 120*b* so that said user 802 can rest his chin on said second pad 706 of said set of pads 702 (referred to supra as said tall configuration 904).

Figure 11A:
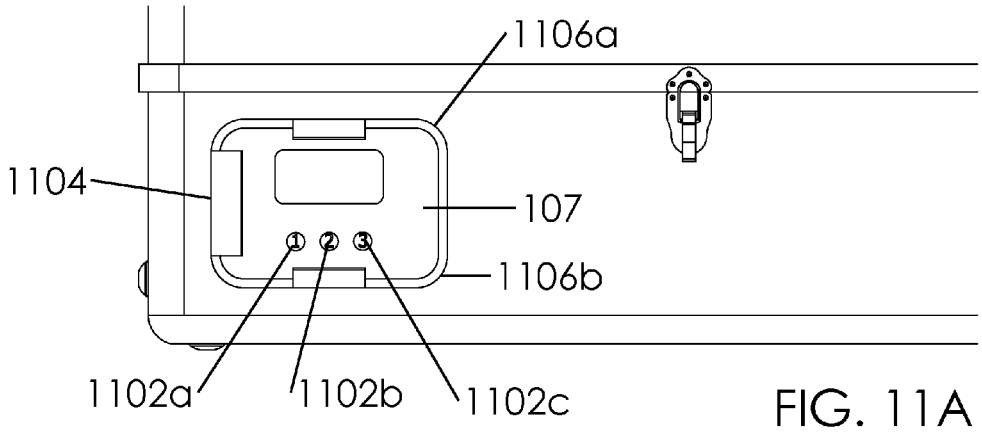
FIGS. 11A, 11B, 11C and illustrate said first side of said head rest assembly with of said timer.
Figure 11B:
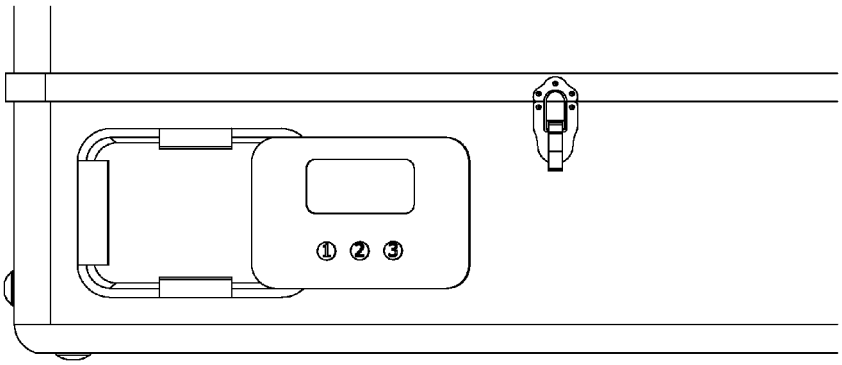
Figure 11C:
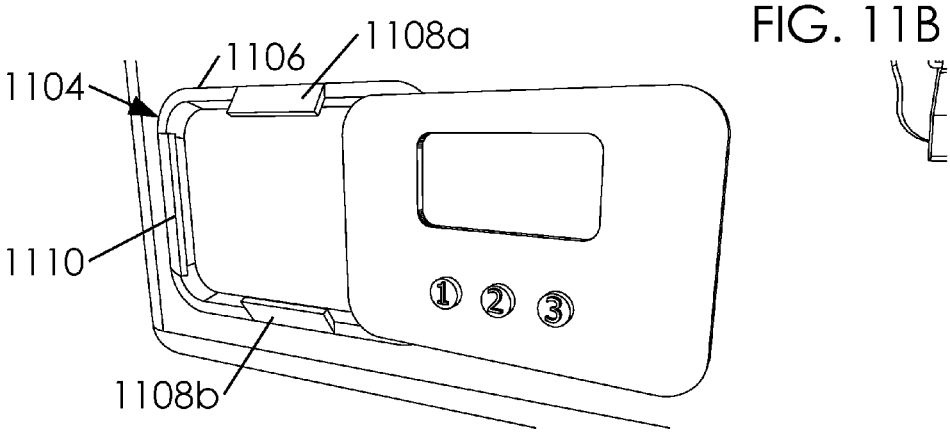

FIGS. 11A, 11B, 11C and illustrate said first side 106*a* of said head rest assembly 100 with of said timer 107. FIG. 11A illustrates a first elevated view with said timer 107 attached to said head rest assembly 100. FIGS. 11B and 11C illustrate a second elevated view and a perspective overview with said timer 107 detached from said head rest assembly 100.

In one embodiment, said timer 107 can comprise one or more buttons. In one embodiment, said one or more buttons can comprise a first button 1102*a*, a second button 1102*b* and a third button 1102*c*. In one embodiment, said user 802 can add or subtract minutes to countdown said timer 107 by pressing said first button 1102*a*. In one embodiment, said user 802 can add or subtract seconds to said timer 107 by pressing said second button 1102*b*. In one embodiment, said user 802 can start/stop said timer 107 by pressing said third button

1102*c*. In one embodiment, said user 802 can reset countdown of said timer 107 by simultaneously pressing said first button 1102*a* and said second button 1102*b* at the same time.

In one embodiment, said timer 107 can be located in the lower left bottom portion of said first side 106*a* of said head rest assembly 100. In one embodiment, said timer 107 can be selectively removed from said head rest assembly 100 for replacement, repair, or battery replenishment. For example, in one embodiment, said timer 107 can be selectively attached to said portion 104 by sliding said timer 107 into a slot 1104. In one embodiment, said slot 1104 can comprise a rim 1106, a first guide 1108*a*, a second guide 1108*b* and a stopper 1110. In one embodiment, said timer 107 can be releaseably attached to said slot 1104 by: sliding a portion of said timer 107 between said first guide 1108*a* and said second guide 1108*b*, pushing said timer 107 against said stopper 1110, and holding said timer 107 within said rim 1106 under said first guide 1108*a*, said second guide 1108*b* and said stopper 1110.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A head rest system comprising:

a head rest assembly comprising a first side, a second side, a top side, a bottom side, a third side and a fourth side;

said top side and said bottom side are not parallel;

said top side comprises a tilted surface comprising a slope angle between said top side and said bottom side;

said head rest assembly comprises a compartment;

said head rest assembly comprising an upper portion and a lower portion;

said upper portion and said lower portion rotateably connected with a hinge;

said head rest assembly further comprising a one or more pads;

said one or more pads releaseably attached to said head rest assembly;

said one or more pads attach to said head rest assembly with a one or more hook-and-loop fasteners;

said head rest assembly comprising a lunch box;

said slope angle of said tilted surface being adjustable;

said head rest assembly comprising a handle;

said handle being releaseably attachable to said head rest assembly with a one or more handle fastening apertures;

said head rest assembly comprising a timer;

said timer being releaseably attachable to said head rest assembly;

said head rest assembly further comprising a slot capable of releaseably holding said timer; and said slot comprising a stopper, a first guide and a second guide.

2. A head rest system comprising:

a head rest assembly comprising a first side, a second side, a top side, a bottom side, a third side and a fourth side;

said top side and said bottom side are not parallel;

said top side comprises a tilted surface comprising a slope angle between said top side and said bottom side;

said head rest assembly further comprising a slot capable of releaseably holding said timer.

3. The head rest system of claim 2 further comprising:

said head rest assembly comprises a compartment.

4. The head rest system of claim 2 further comprising:

said head rest assembly comprising an upper portion and a lower portion.

5. The head rest system of claim 4 further comprising:

said upper portion and said lower portion rotateably connected with a hinge.

6. The head rest system of claim 2 further comprising:

said head rest assembly further comprising a one or more pads.

7. The head rest system of claim 6 further comprising:

said one or more pads releaseably attached to said head rest assembly.

8. The head rest system of claim 6 further comprising:

said one or more pads releaseably attached to said head rest assembly with a one or more hook-and-loop fasteners.

9. The head rest system of claim 2 further comprising:

said head rest assembly comprises a compartment and said compartment adapted for use as a lunch box.

10. The head rest system of claim 2 further comprising:

said slope angle of said tilted surface being adjustable.

11. The head rest system of claim 2 further comprising:

said head rest assembly comprising a handle.

12. The head rest system of claim 2 further comprising:

said handle being releaseably attachable to said head rest assembly with a one or more handle fastening apertures.

13. The head rest system of claim 2 further comprising:

said head rest assembly comprising a timer.

14. The head rest system of claim 13 further comprising:

said timer being releaseably attachable to said head rest assembly.

15. The head rest system of claim 2 further comprising:

said slot comprising a stopper, a first guide and a second guide.

* * * * *